United States Patent [19]

Debaise

[11] 4,239,194

[45] Dec. 16, 1980

[54] TUYERE FOR THE BOTTOM OF A STEELWORKS CONVERTER

[75] Inventor: Michel J. Debaise, Mont-sur-Marchienne, Belgium

[73] Assignee: Hainaut-Sambre Societe Anonyme, Belgium

[21] Appl. No.: 50,880

[22] Filed: Jun. 21, 1979

[30] Foreign Application Priority Data

Jun. 23, 1978 [BE] Belgium ..... 868431

[51] Int. Cl.[3] ..... C21B 7/16

[52] U.S. Cl. ..... 266/270; 75/60

[58] Field of Search ..... 266/270; 75/60

[56] References Cited

U.S. PATENT DOCUMENTS

| | | | |
|---|---|---|---|
| 3,043,578 | 7/1962 | Cohn | 266/270 |
| 3,558,119 | 8/1967 | Demalander | 266/270 |
| 3,793,002 | 1/1974 | Borgnat | 75/60 |
| 3,794,308 | 2/1974 | Ponghis | 266/270 |
| 3,917,243 | 11/1975 | Borgnat | 266/270 |

*Primary Examiner*—P. D. Rosenberg

*Attorney, Agent, or Firm*—Holman & Stern

[57] ABSTRACT

A tuyere for the bottom of a steelworks converter comprises a convergent duct connected to one end of a cylindrical tube. A sheath of abrasion-resistant material, e.g. $Al_2O_3$-based ceramic material or electrochromed steel, is inserted in the internal wall of the tube for 150–300 mm from the point at which the duct is connected to the tube.

13 Claims, 1 Drawing Figure

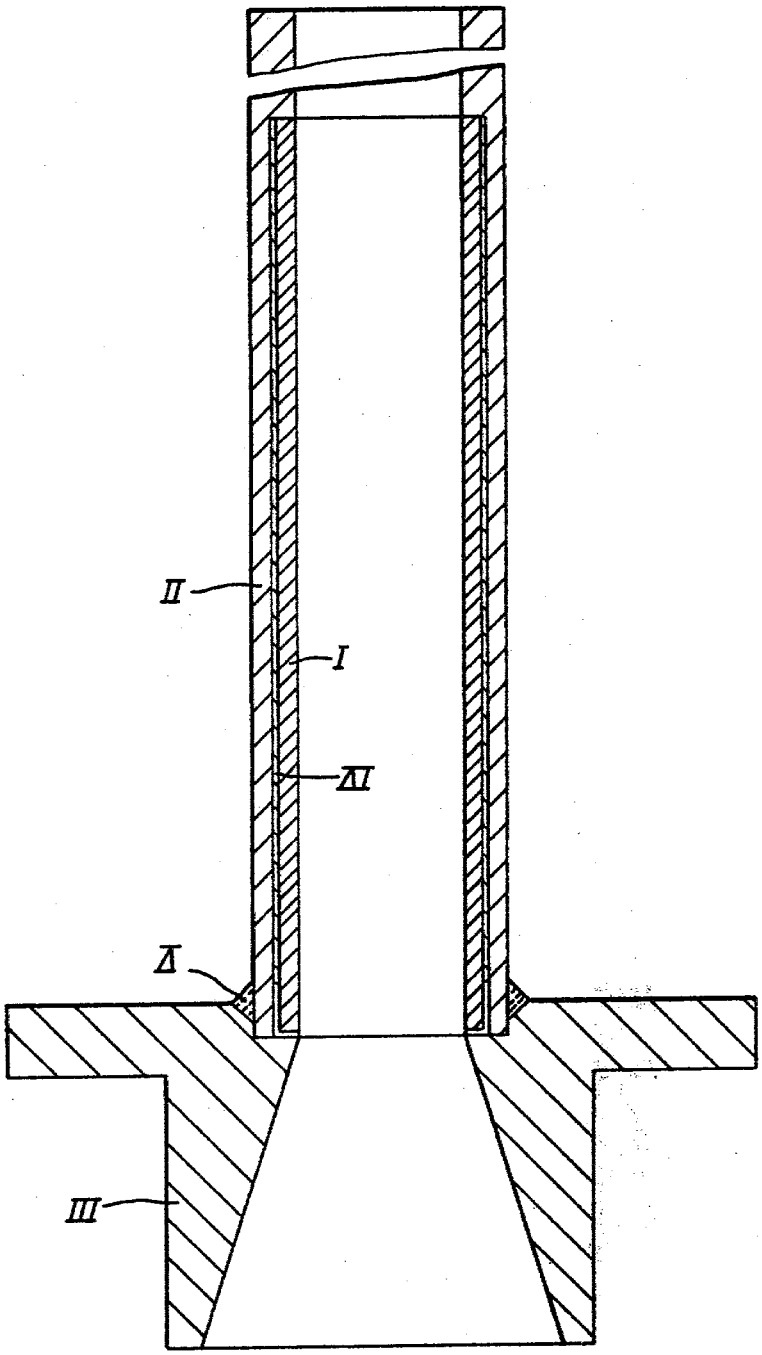
II
I
III
IV
III

TUYERE FOR THE BOTTOM OF A STEELWORKS CONVERTER

FIELD OF THE INVENTION

The present invention relates to a tuyere designed to blow refining fluid through the bottom of steelworks converters. This tuyere is particularly advantageous if the refining fluid is oxidising, in particular technically pure oxygen, and contains a powdered material, such as for example lime, in suspension.

BACKGROUND OF THE INVENTION

It is known that the bottoms of steelworks converters provided with blast tuyeres are very expensive. Consequently steel specialists have given considerable attention to increasing the service life of these bottoms as much as possible. The service life not only depends on the wear of the lining constituting the bottom, but also on the wear of the blast tuyeres. The present invention therefore relates to a tuyere whose particular construction ensures an extended service life with respect to the average at present obtained.

The invention is based on the following considerations. During numerous tests with tuyeres comprising a cylindrical tube into which at least one refining fluid is introduced by means of a convergent duct located at one end of this tube, the other end communicating with the converter, we observed that the tuyeres exhibited wear due to abrasion localised in a short zone of the tube. In order to reduce this wear, it is necessary to protect this zone by means of an abrasion resistant material and, in particular, a material which is resistant to abrasion by lime suspended in the blast. We also observed that the length of the zone exhibiting wear was dependent on the shape of the convergent duct. Furthermore, it is advantageous to limit the length of the tube to be protected to a minimum, as the cooling of the tuyere by the passage of the fluid is one of the factors contributing to the effective resistance of the tuyere.

SUMMARY OF THE INVENTION

Consequently, the tuyere of the present invention, comprising at least one cylindrical tube into which at least one refining fluid is introduced by means of a convergent duct disposed at one end of this tube, the other end communicating with the converter, further comprises an internal sheath constituted by a material having good resistance to abrasion, said sheath being coaxial with the cylindrical tube and inserted in the internal wall of the tube for a length of between 150 and 300 mm, from the point at which the tube is connected to the convergent duct. The said length is determined as a function of the shape of the convergent duct and the composition of the metal constituting the tube.

Preferably, the protective sheath is located in a bore provided in the wall of the tube over a length equal to that of the sheath increased by 0.1 mm to 0.2 mm, the diameter of the bore being at least equal to the outer diameter of the protective sheath, preferably increased by 1 mm to 3 mm. The inner diameter of the protective sheath is preferably substantially equal to the nominal inner diameter of the tube to be protected, the possible difference between these two diameters preferably being less than 3 mm.

In a preferred embodiment of the invention, the protective sheath is made rigid with the tube by means of a mineral cement, spread as uniformly as possible in the form of a film in the annular space between the sheath and the tube. The annular space is preferably free of cement over a length of approximately 10 mm at the position of a weld bead between the tube and the convergent duct in order to avoid risks of cracking during fixing of the convergent duct.

The convergent duct is preferably made rigid with the tube by welding on an assembly template and by subjecting the surface of the flange facing the tube to lathe-turning without impairing the weld, so as not to strain the tube-duct connection.

The protective sheath may be constituted by a ceramic material, for example an alumina ($Al_2O_3$) based material having an $Al_2O_3$ content preferably higher than 60%. Alternatively, the sheath may be of electrochromed steel.

The cylindrical tube and the convergent duct may be of stainless steel or, preferably, of copper, in order to increase the heat exchange between the tube and the refining fluid. It is indeed possible to use copper for the tuyere protected by an internal sheath, as the low hardness of copper no longer constitutes a handicap from the point of view of resistance to abrasion.

BRIEF DESCRIPTION OF THE DRAWING

The accompanying drawing, by way of non-limiting example, shows a structural embodiment of a tuyere for the bottom of a steelworks converter, in fragmentary axial section.

DESCRIPTION OF PREFERRED EMBODIMENT

A protective sheath I is inserted in the inner wall of a cylindrical tube II rigid with a convergent duct III. The sheath I is fixed to the tube II in an enlarged part of the bore of the tube by means of a mineral cement IV. The sheath is left free of cement over a length of about 10 mm at the position of a weld V between the tube and the duct.

Tests were carried out with tuyeres whose tubes were stainless steel. The bottom of the converter had a diameter of 1400 mm, and was provided with 18 tuyeres with a diameter of 28 mm. The convergent ducts were of the frusto-conical type, opening angle 30°. The protective sheath I was made of 98% $Al_2O_3$ ceramic material and its length was 180 mm. The enlarged part of the bore of the tube had a diameter 1 to 3 mm larger than the external diameter of the sheath, and had a length of 180.1 to 180.2 mm. The internal diameters of the sheath and the tube were equal, with a tolerance of 3 mm.

Whereas tuyeres without protective sheaths have a service life of 300 to 400 heats, the tests showed that the tuyeres with protective sheaths have a service life increased to 500 castings, with an adequate safety factor.

The above-described tuyeres also have the following advantages:

(1) they may be used with supply systems which are uncomplicated from the point of view of the dynamics of the fluid flow, in contrast to other more complex systems which are almost impossible to use for bottoms having tuyeres disposed in parallel rows;

(2) manufacturing costs are lower than those for similar tuyeres at present used, and the difference may increase to more than 15%.

I claim:

1. A tuyere for the bottom of a steelworks converter, comprising a cylindrical tube, and a convergent duct the narrower end of which is connected to one end of the tube, for introducing a refining fluid into the tube, and an internal sheath of abrasion-resistant material, the sheath being coaxial with the tube and inserted in the internal wall of the tube over a length of 150 to 300 mm extending from the point at which the convergent duct is connected to the tube.

2. A tuyere as claimed in claim 1, in which the sheath is disposed in an enlarged part of the bore of the tube, the length of the said part being 0.1 to 0.2 mm greater than that of the sheath.

3. A tuyere as claimed in claim 1, in which the sheath is disposed in an enlarged part of the bore of the tube, the diameter of the said part being 1 to 3 mm greater than the outer diameter of the sheath.

4. A tuyere as claimed in claim 1, in which the inner diameter of the sheath is substantially equal to the nominal inner diameter of the tube.

5. A tuyere as claimed in claim 1, in which the sheath is fixed to the tube by means of mineral cement in the form of a substantially uniform film between the sheath and the tube.

6. A tuyere as claimed in claim 5, in which the sheath is free of cement over a length of approximately 10 mm at the position of a weld bead between the tube and the convergent duct.

7. A tuyere as claimed in claim 1, in which the convergent duct is rigid with the tube.

8. A tuyere as claimed in claim 7, in which the convergent duct is welded to the tube and has a flange, the surface of the flange facing the tube having been machined without impairing the weld.

9. A tuyere as claimed in claim 1, in which the sheath is of ceramic material.

10. A tuyere as claimed in claim 9, in which the sheath is of $Al_2O_3$-based ceramic material.

11. A tuyere as claimed in claim 1, in which the sheath is of electro-chromed steel.

12. A tuyere as claimed in claim 1, in which the tube and the convergent duct are of stainless steel.

13. A tuyere as claimed in claim 1, in which the tube and the convergent duct are of copper.

* * * * *